US005911798A

United States Patent [19]

Arnold

[11] Patent Number: 5,911,798

[45] Date of Patent: Jun. 15, 1999

[54] HANDLE EXTENSION FOR RATCHET WRENCH

[75] Inventor: Robert L. Arnold, Jacobus, Pa.

[73] Assignee: Hand Tool Design Corporation, Wilmington, Del.

[21] Appl. No.: 08/832,680

[22] Filed: Apr. 9, 1997

[51] Int. Cl.[6] ..... B25B 23/16

[52] U.S. Cl. ..... 81/177.2; 81/177.1; 81/489

[58] Field of Search ..... 81/177.1, 177.2, 81/177.6, 180.1, 184, 489, 900; 16/115

[56] References Cited

U.S. PATENT DOCUMENTS

| | | | |
|---|---|---|---|
| 1,493,983 | 5/1924 | Hurley . | |
| 1,715,902 | 6/1929 | Countryman . | |
| 2,438,633 | 3/1948 | Condor . | |
| 2,520,652 | 8/1950 | Pfauser et al. . | |
| 2,572,444 | 10/1951 | Carden . | |
| 2,627,330 | 2/1953 | Gantz . | |
| 2,691,316 | 10/1954 | Brame . | |
| 2,869,410 | 1/1959 | Prichard . | |
| 2,963,930 | 12/1960 | Clothier et al. . | |
| 2,964,981 | 12/1960 | Blunt . | |
| 3,002,409 | 10/1961 | Jones . | |
| 3,227,015 | 1/1966 | Tremblay . | |
| 3,270,597 | 9/1966 | Neff et al. . | |
| 3,306,639 | 2/1967 | Lyon | 81/177.2 |
| 3,343,434 | 9/1967 | Schroeder . | |
| 4,070,932 | 1/1978 | Jeannotte . | |
| 4,317,393 | 3/1982 | Graffam . | |
| 4,367,663 | 1/1983 | Merics . | |
| 4,409,866 | 10/1983 | McBride | 81/177.2 |
| 4,581,958 | 4/1986 | Shull . | |
| 4,589,308 | 5/1986 | Palm . | |
| 4,733,584 | 3/1988 | Karge . | |
| 4,754,670 | 7/1988 | Raymond . | |
| 4,811,637 | 3/1989 | McCleary | 81/177.2 |
| 4,913,007 | 4/1990 | Reynolds . | |
| 4,951,409 | 8/1990 | Froid . | |
| 5,033,337 | 7/1991 | Thomas, III . | |
| 5,099,724 | 3/1992 | Reddy, Jr. | 81/177.2 |
| 5,109,737 | 5/1992 | Raber . | |
| 5,138,911 | 8/1992 | Lan . | |
| 5,279,189 | 1/1994 | Marino . | |
| 5,285,702 | 2/1994 | Hillinger . | |
| 5,289,745 | 3/1994 | Beardsley . | |
| 5,299,475 | 4/1994 | Stroop | 81/489 |
| 5,396,820 | 3/1995 | Baker . | |
| 5,404,615 | 4/1995 | Wafer et al. . | |
| 5,471,899 | 12/1995 | Twomlow . | |
| 5,499,560 | 3/1996 | Aeschliman . | |
| 5,517,884 | 5/1996 | Sanders . | |

FOREIGN PATENT DOCUMENTS

| | | | |
|---|---|---|---|
| 62270 | 10/1982 | European Pat. Off. | 81/177.1 |
| 254135 | 1/1988 | European Pat. Off. | 81/177.1 |
| 49878 | 3/1991 | Japan | 81/177.2 |

*Primary Examiner*—David A. Sherbel
*Assistant Examiner*—Joni B. Danganan
*Attorney, Agent, or Firm*—Leonard Bloom

[57] ABSTRACT

A tool is provided with a handle extension, including inner and outer telescoping members. The inner member is press-fitted to the handle of the tool, and the outer member is configured to provide a comfortable grip for the user of the tool. A spring-loaded detent means between the inner and outer members provides two alternate positions, constituting a normal position in which the outer member is disposed radially of the inner member (and of the handle of the tool) and an extended position in which the outer member is disposed rearwardly of the handle of the tool for providing increased manual leverage in using the tool. In a preferred embodiment, the tool is a ratchet wrench and the telescoping members are molded of a suitable plastic.

23 Claims, 6 Drawing Sheets

HANDLE EXTENSION FOR RATCHET WRENCH

FIELD OF THE INVENTION

The present invention relates to a handle extension, and more particularly, to a handle extension for a torque applying tool, such as a ratchet wrench, breaker bar or the like.

BACKGROUND OF THE INVENTION

In order to gain access to machine parts located at different distances from the outer surface of the machine, it is essential for an operator to have a tool with a handle (or shank) of sufficient length to reach the machine parts. Handle extensions affixed to a handle of a tool (such as, for example, wrenches) permit an operator to reach machine parts located at distant locations. These handle extensions typically include a sleeve telescopically movable relative to the handle of the tool. The parts can be detented in several positions with respect to each other.

The handle extension is particularly useful for providing increased leverage or torque in the use of the tool.

A variety of handle extensions, and tools with extensible shanks, are disclosed in a number of prior art publications.

For example, U.S. Pat. No. 2,438,633 discloses an extensible tool shank having a cylindrical sleeve and a square cross-sectioned bar longitudinally slidable (but not turnable) in the sleeve. A series of spaced-apart notches along the bar engage with projections on the sleeve for the purpose of adjusting the extension.

U.S. Pat. No. 2,963,930 discloses an extensible torque bar having a cylindrical torque tube with a non-circular internal channel and a torque rod slidably (but non-rotatably) carried in the channel. The torque rod has a series of notches, and a torque tube carries a ball detent which is capable of engaging a respective notch on the torque rod and of being locked therein for the length adjustment.

U.S. Pat. No. 3,227,015 discloses a socket wrench with an extension feature and includes a pair of cylindrical telescoping members capable of being locked in several relative dispositions with respect to another.

U.S. Pat. No. 4,070,932 discloses an extensible handle for a ratchet wrench. The handle includes a cylindrical sleeve which carries the tool headpiece and a cylindrical rod which is telescopically received within the sleeve and is resiliently biased towards an extended position. A latch is provided for locking the rod in a retracted position and in an extended position, respectively.

U.S. Pat. No. 4,581,958 discloses an extensible handle assembly for a ratchet wrench or the like, which includes a cylindrical handle member and a tool shank extended internally within the handle member. The shank is slidable in the handle member between extended and retracted positions. The handle member has a spring-biased-ball to engage the shank at each of these positions.

U.S. Pat. No. 5,109,737 discloses a ratchet wrench having a cylindrical sleeve slidable and rotatable on the handle of the ratchet. The sleeve is provided with a plurality of holes to receive a detent affixed to the handle for positioning the sleeve.

U.S. Pat. No. 5,396,820 discloses an open end wrench with an extensible handle, which has a primary handle over which an extension may be slid to various positions for increasing or decreasing the torque applied to the tool. The primary handle is provided with a plurality of notches while the extension has a thumb press which engages a respective notch for adjusting the handle extension.

U.S. Pat. No. 5,471,899 discloses a ratchet wrench with a handle extension feature, which includes an inner shaft (which is a handle of the wrench) provided with aligned lock pin holes therealong. An outer cylindrical sleeve is mounted telescopically and fits snugly about the inner shaft for axial movement relative thereto. At its proximal end, the sleeve carries a pair of lock pins which engage respective lock pin holes on the inner shaft for the purpose of adjusting the handle length.

In all of the above-described prior art handle extensions for wrenches (and the like) the shank or handle of the tool must be modified to provide a certain detent means cooperating with a slidable extension member telescopically mounted on the handle. This required modification of the tool handle may be undesirable since, first, it is an extra element of manufacturing cost and, second, it creates localities of additional stress in the shank which can dilute its structural integrity and precipitate a product failure.

Therefore, it would be very desirable if the handle extension would not require any secondary machining or rework of the tool handle, nor add unnecessary manufacturing cost, and yet would be comfortable to use and preserve the structural integrity of the tool handle.

SUMMARY OF THE INVENTION

Therefore, it is an object of the present invention to provide a handle extension for a tool (a ratchet wrench, breaker bar and the like) which alleviates the disadvantages and deficiencies of the handle extensions habitually resorted to in the prior art.

It is another object of the present invention to eliminate any secondary machining or modification of the existing handle of the ratchet wrench or other hand tool.

According to the teachings of the present invention, the handle extension includes a two-piece assembly including inner and outer telescoping molded plastic members. The inner member (or an adapter) is secured to the handle of the ratchet wrench, and the outer member (or handle extending member) is configured so as to provide a comfortable grip for the user of the ratchet wrench. Preferably, a resiliently-biased detent means between the inner and outer members provides, first, a normal position in which the outer member is disposed radially of the inner member (and of the handle of the ratchet wrench) and, second, an extended position in which the outer member is disposed rearwardly of the handle of the ratchet wrench, thereby providing additional leverage and reach.

The inner member is secured to the handle of the ratchet wrench; and in a preferred embodiment thereof, the handle has a circular cross-section and is press-fitted within a longitudinal bore formed within the inner member.

Preferably, the outer member is a hollow member having two opposite side walls with a guide rail provided internally on each of opposite side walls. The guide rails are aligned to each other and extend substantially the length of the outer member. The inner member has opposite side walls with respective elongated side recesses extending substantially the length of the inner member and in substantial registration with the respective guide rails on the outer member, so that the inner member reciprocates within the outer member with the side recesses sliding along the mating guide rails.

Preferably, the detent means comprises a leaf spring secured to a wall connecting the side walls of the outer member at its end close to the handle. The leaf spring engages a first notch provided at the proximate end of the inner member for retaining the handle extension in its normal position. When the leaf spring engages a second notch provided at the distal end of the inner member, the handle extension is retained in its extended position providing for increased manual leverage in using the ratchet wrench.

These and other objects of the present invention will become apparent from a reading of the following specification taken in conjunction with the enclosed drawings.

DESCRIPTION

Figure 1:
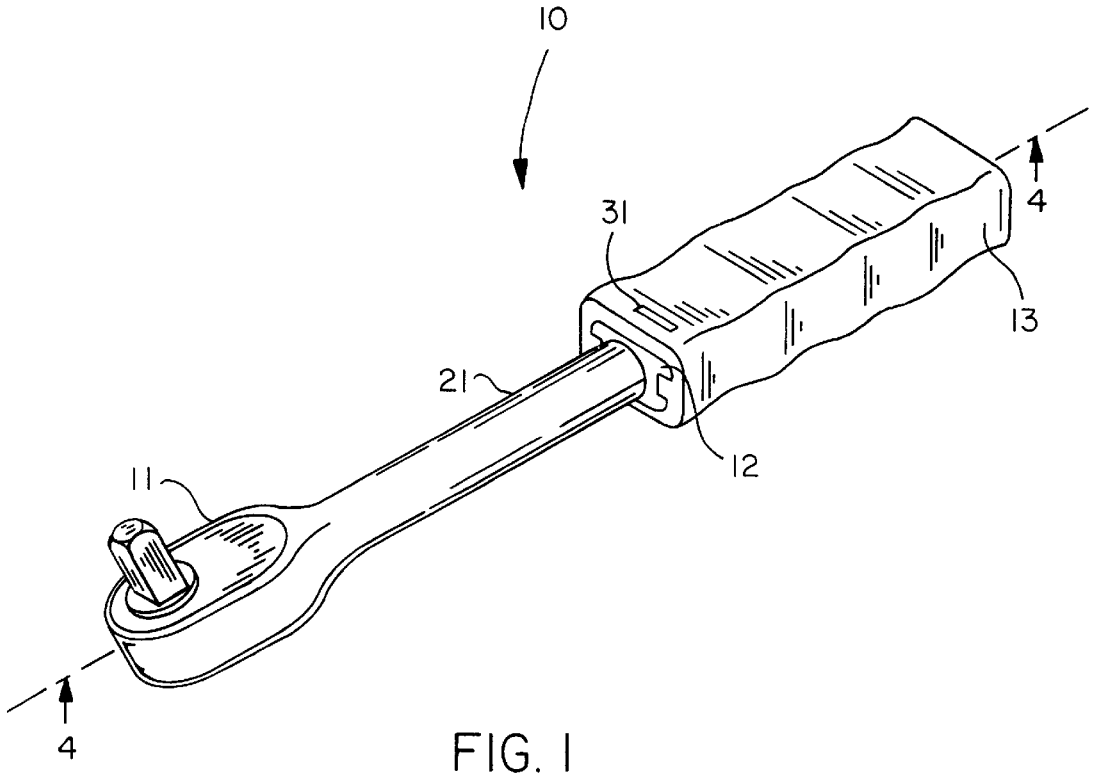
FIG. 1 is a perspective view of the ratchet wrench with the handle extension of the present invention in the normal position thereof.
Figure 2:
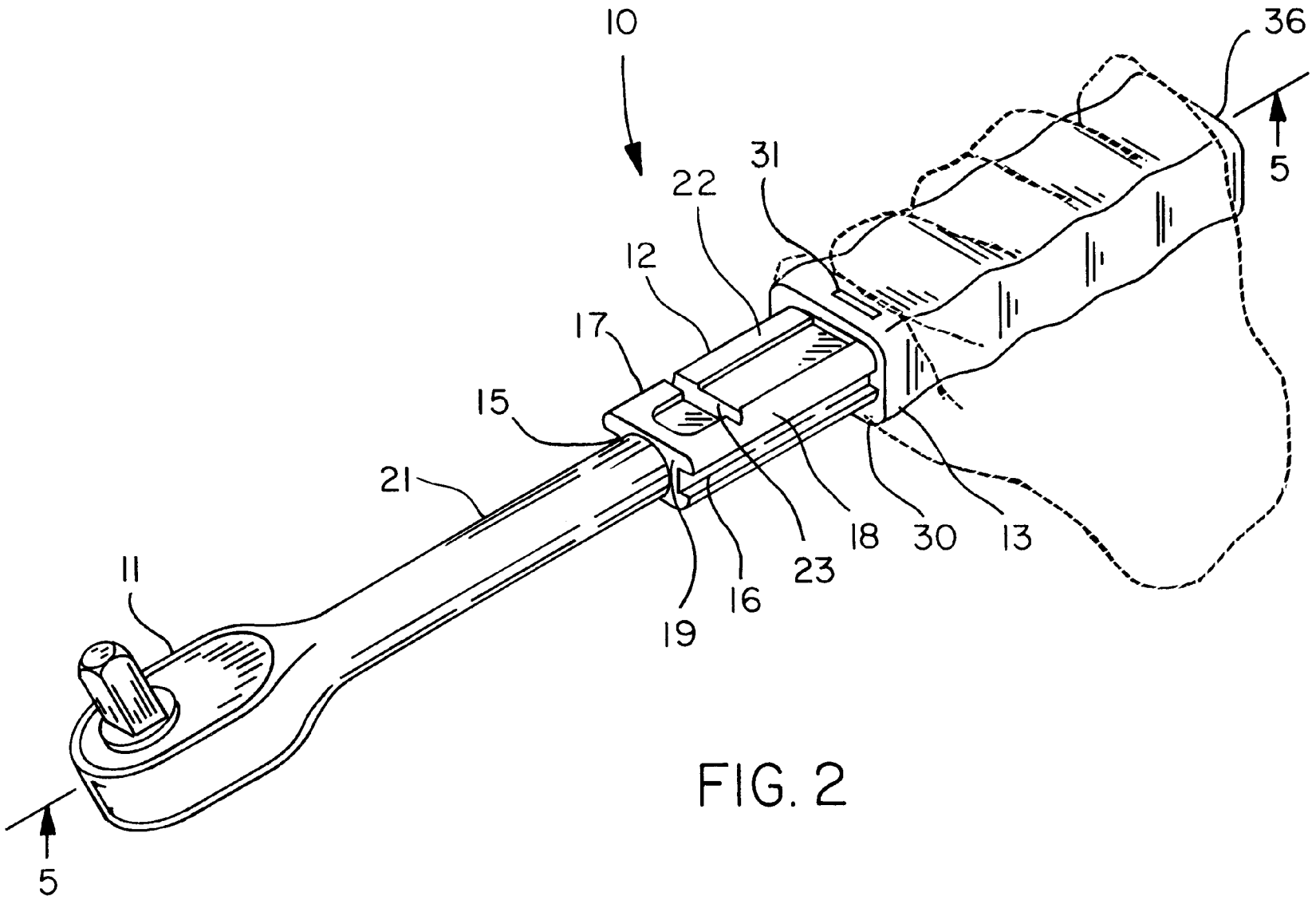
FIG. 2 is another perspective view of the ratchet wrench with the handle extension of the present invention in the extended position thereof.
Figure 3:
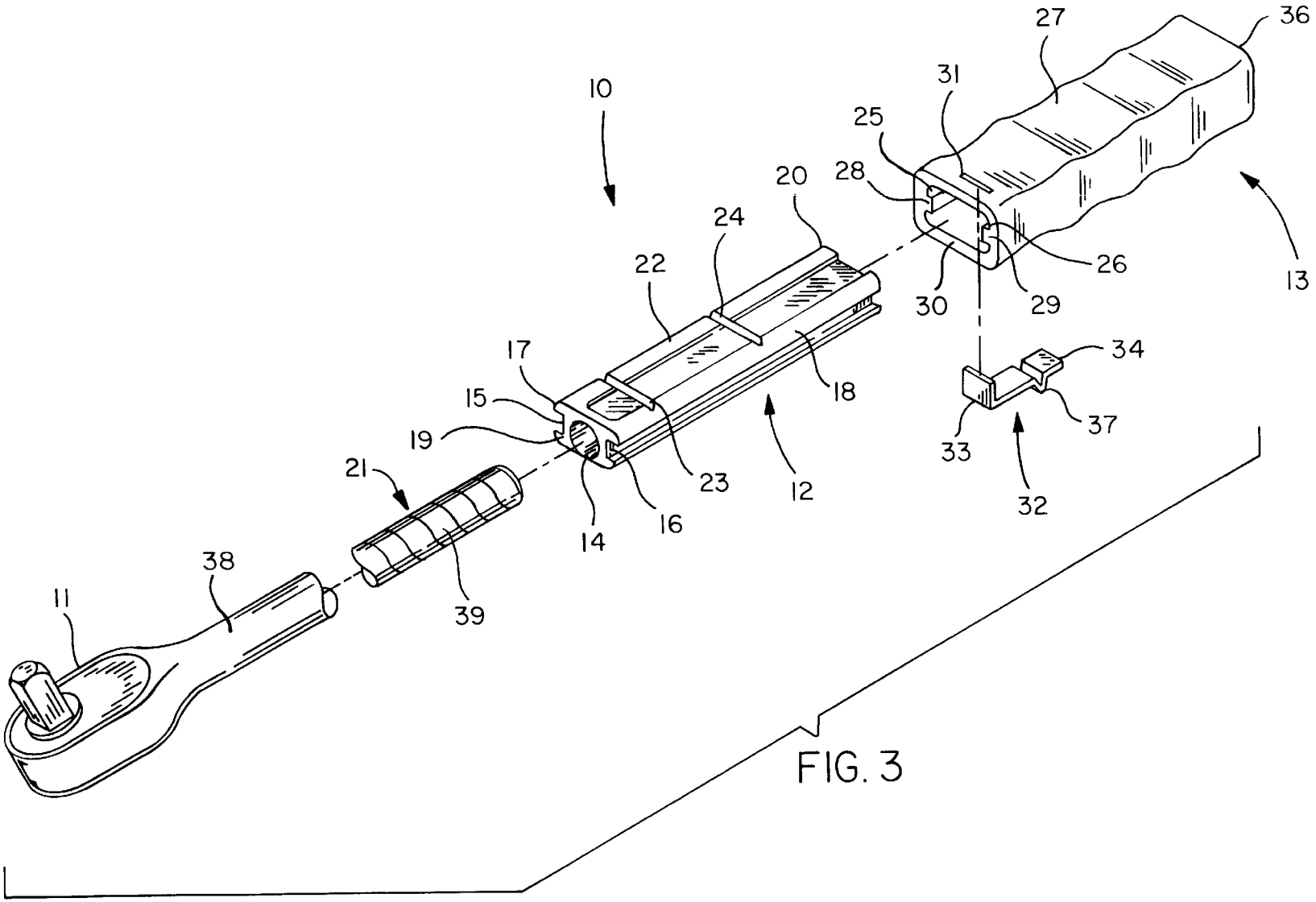
FIG. 3 is a perspective exploded view of the ratchet wrench with the handle extension of the present invention.

Referring to FIGS. 1–8, a handle extension 10 for a ratchet wrench 11 (or any tool) comprises a two-piece assembly including a telescoping inner member (or an adapter) 12 and an outer member (or handle extending member) 13, respectively. Preferably, these members 12 and 13 are molded from a relatively high impact plastic material (for instance, a glass-filled nylon material, an engineering plastic, etc.), thereby providing user convenience and comfort as well as strength and durability, consonant with relatively low manufacturing cost. Also, die castings can be used.

Additionally, the inner member 12 of the handle extension 10 can be molded directly to an existing shank or handle, or else can be a molded member press-fitted thereon, and no modification of the shank or handle is necessary.

The inner member 12 is a molded (or die-cast) member having a longitudinal bore 14 of a circular cross-section. The inner member 12 has side recesses 15 and 16 on its opposite side walls 17 and 18. The inner member 12 further has an open proximate end 19 and a blind (closed) distal end 20. A longitudinal channel or bore 14 extends the whole length of the inner member 12 from the proximate end 19 to the distal end 20 and accommodates a handle (or a shank) 21 of the ratchet wrench 11. The bore 14 is dimensioned and shaped with respect to the handle 21 to which it is intended; and the inner member 12 is suitably secured to the handle 21 as, for example, by a press fit or interference fit.

The inner member 12 further has a wall (such as its upper wall 22) provided with a pair of spaced-apart notches 23 and 24. The notch 23 is positioned in proximity to the proximate end 19, and the notch 24 is positioned close to the distal end 20 of the inner member 12.

The outer member 13 is a hollow molded plastic member having side walls 25 and 26 and an upper (or a bottom) wall 27. As best shown in FIGS. 1–5, the outside surface of the outer member 13 is shaped to provide a comfortable grip for the user of the ratchet wrench 11. Guide rails 28 and 29 extend substantially the whole length of the outer member 13 along the side walls 25, 26 thereof. The guide rails 28 and 29 are aligned to each other and are configured to slidably fit into the side recesses 15, 16 on the inner member 12; so that once the inner member 12 is received by its distal end 20 into a proximate end 30 of the outer member 13, it can slidably reciprocate therein with the side recess 15 and 16, respectively, sliding along the respective guide rails 28 and 29.

Internally, the outer member 13 is configured precisely to accommodate the inner member 12 with the guide rails 28, 29 within the respective side recesses 15, 16.

A slot is provided at the bottom wall in a close proximity to the proximate end 30 of the outer member 13. For the purposes of better illustration, the slot 31 is shown as being provided on the bottom wall 27. A leaf spring 32, best shown in FIGS. 3–5 and 8, serves as detent for retaining the handle extension in one of two positions: normal or extended.

The leaf spring 32 has a lip 33 press-fitted in the slot 31 and a plate 34 extended along an internal surface 35 of the upper wall 27 from the slot 31 toward a rear end 36 of the outer member 13. The plate 34 is bent to form a projection or "bumps" 37 extending away from the wall 27. The bump 37 is configured and sized to fit tightly into the alternate notches 23 and 24. Preferably, the leaf spring is received in a recessed portion in the inner member 12.

Figure 4:
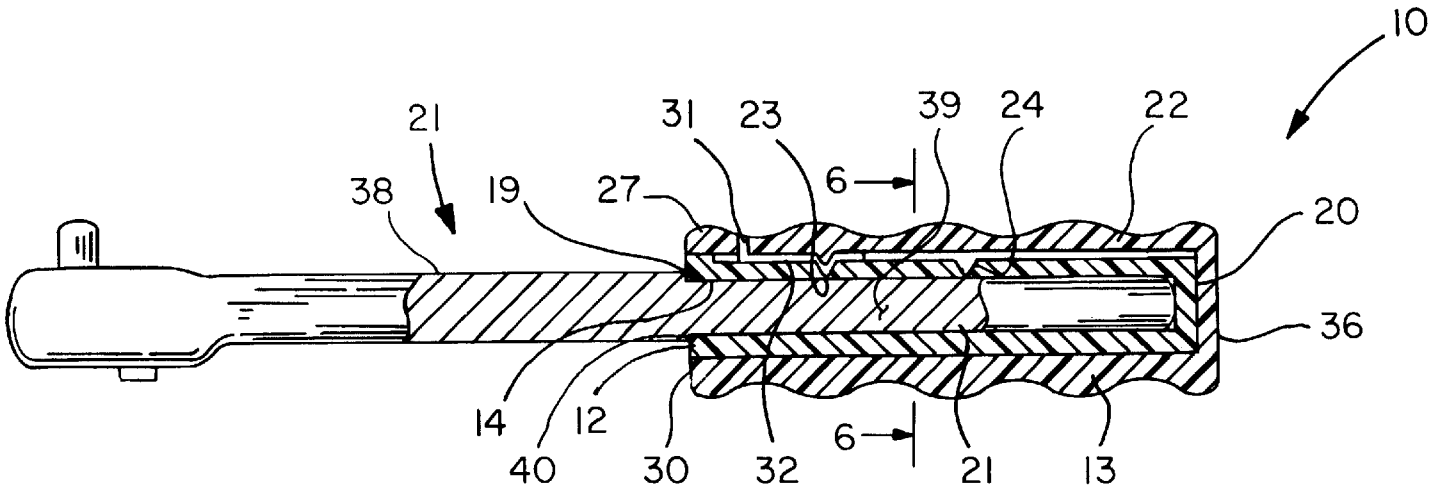
FIG. 4 is a longitudinal section view of FIG. 1 taken along lines 4—4 thereof.
Figure 5:
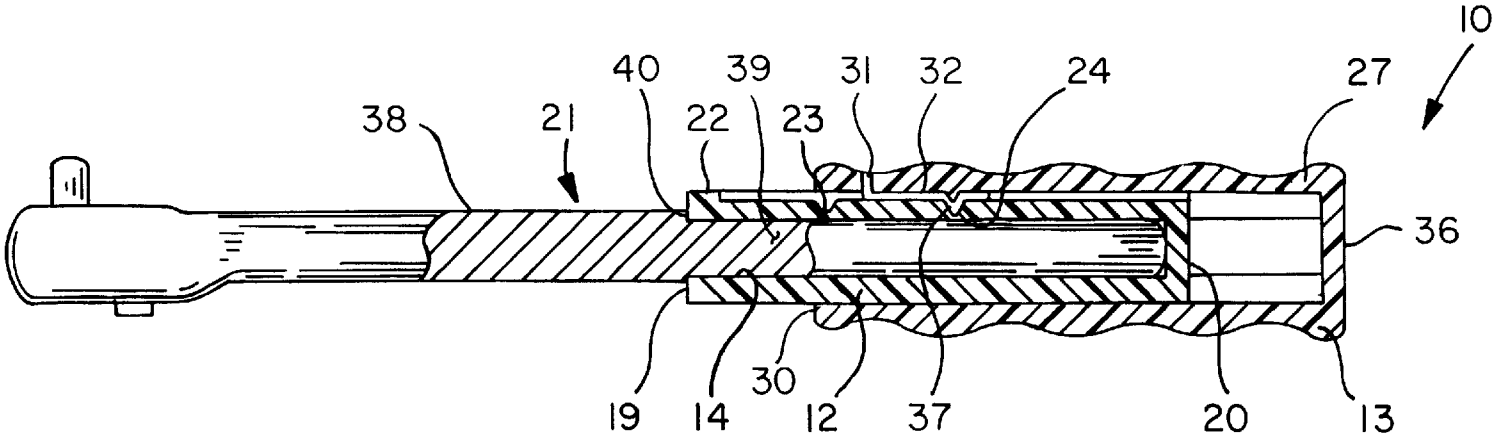
FIG. 5 is a longitudinal section view of FIG. 2 taken along lines 5—5 thereof.
Figure 7:
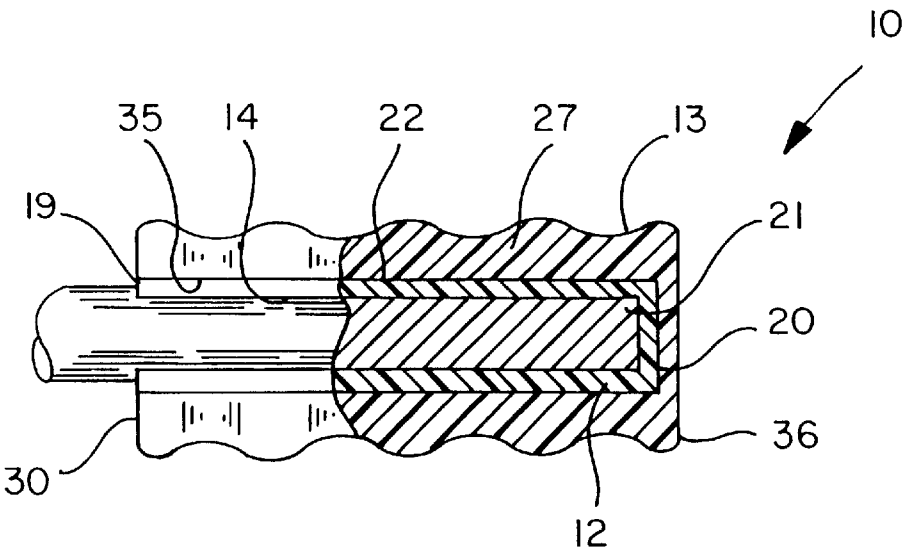
FIG. 7 is a cross-section of FIG. 6 taken along lines 7—7 thereof.
Figure 6:
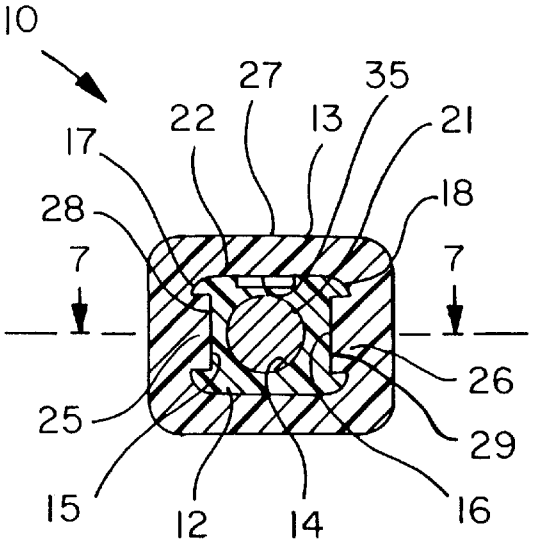
FIG. 6 is a cross-section of FIG. 4 taken along lines 6—6 thereof, and drawn to an enlarged scale.
Figure 8:
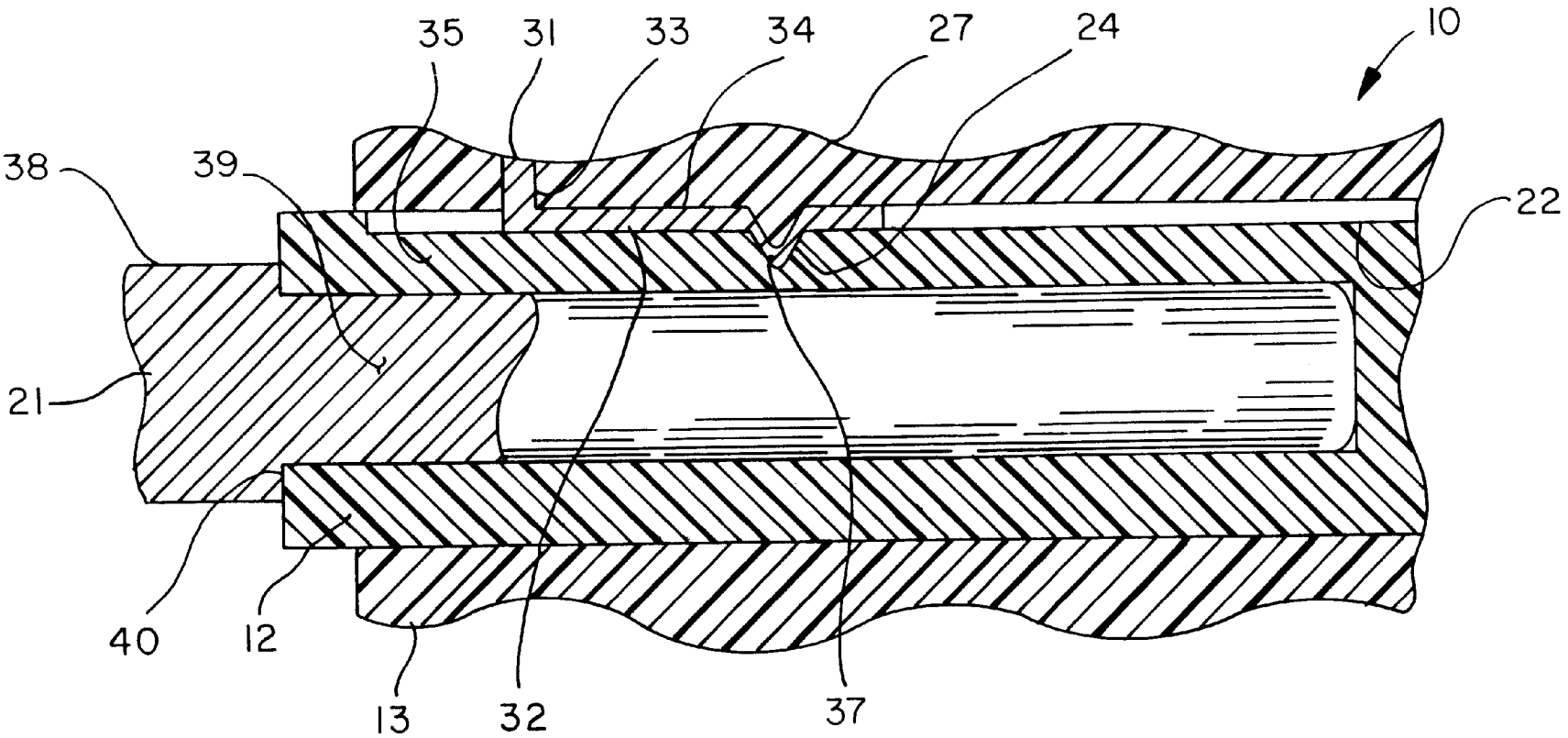
FIG. 8 is an enlarged portion of FIG. 5, showing the leaf spring and the detent means of the handle extension of the present invention.

As best shown in FIG. 4, when the inner member 12 has been inserted into the outer member 13, and the bump 37 engages the notch 23, then the handle extension 10 is releasably locked in its normal position. However, and as best shown in FIG. 5, when the inner member 12 is extended from the outer member 13, and the bump 37 engages the notch 24, then the handle extension 10 is releasably locked in its extended position, and the ratchet wrench 11 can be employed to increase the amount of torque or leverage to be applied, as desired.

It will be appreciated by those skilled in the art that more than two notches (similar to the notches 23 and 24) can be provided on the wall 27 of the outer member 13, so as to adjust the length of the handle extension 10, as desired.

To assemble the preferred embodiment of the ratchet wrench 11 with the handle extension 10

The leaf-spring 32 is carried by the outer member 13;

The inner member 12 is press-fitted to the handle 21 of the ratchet wrench 11; and The inner member 12 is inserted into the outer member 13, with the guide rails 28, 29 in the respective side recesses 15, 16.

By providing two separate telescoping members, it is not necessary to modify an existing handle for a ratchet wrench or other hand tool or implement; and these telescoping members, constituting an inner member and an outer member, respectively, may be molded economically from a suitable high-impact plastic material. As a result, operator comfort and convenience is assured together with high strength, durability and low manufacturing cost. The handle extension can be molded to a new handle design, which is cylindrical in a preferred embodiment for reduced manufacturing cost. Additionally, the members may be molded in attractive colors for consumer appeal. These are practical and valuable features and advantages, heretofore not available in the prior art.

Preferably, CNC machinery is to be used for better controlling dimensions of all parts, reducing manufacturing costs and for better quality. Once the ratchet wrench 11 is manufactured with the handle having a broader portion 38 and a narrower portion 39 thereon and with a shoulder 40 therebetween (as best shown in FIGS. 3–5 and 7–8), a surface of the narrower portion 39 can be knurled in one simple and inexpensive operation on the CNC machinery and the adapter (inner member) 12 is press-fitted on the handle 21 with the narrower portion 39 thereof within the longitudinal channel 14 of the adapter 12. The shoulder 40 prevents the adapter 12 from unwanted movement thereof towards the broader portion 38 of the handle 21. After securing the adapter 12 to the handle 21, the handle extending (or outer) member 13 is put on the adapter 12.

Obviously, many modifications may be made without departing from the basic spirit of the present invention. For example, the members could be die cast or an investment casting in lieu of molded plastic members. Accordingly, it will be appreciated by those skilled in the art that within the scope of the appended claims, the invention may be practiced other than has been specifically described herein.

I claim:

1. A tool comprising a handle, a handle extension including a two-piece assembly including inner and outer telescoping members, the inner member being secured to the handle of the tool and the outer member being configured to provide a comfortable grip for the user of the tool, resiliently-biased detent means between the inner and outer members providing at least two alternate positions therebetween and constituting a normal position in which the outer member is disposed radially of and adjacent to the inner member and radially of the handle of the tool and an extended position in which the outer member is disposed rearwardly of and distal from the handle of the tool for providing increased manual leverage in using the tool.

2. The tool of claim 1, wherein the tool is a ratchet wrench.

3. The tool of claim 1, wherein the inner and outer members comprise molded plastic members.

4. The tool of claim 1, wherein the inner and outer members comprise die-cast members.

5. The tool of claim 1, wherein the inner member includes a longitudinal channel extending substantially the length thereof, and wherein the handle is press-fitted within said longitudinal channel formed in the inner member.

6. The tool of claim 5, wherein the handle and the longitudinal channel in the inner member are of circular cross-section.

7. The tool of claim 1, wherein the inner and outer telescoping members are elongated.

8. The tool of claim 7, wherein the outer member is hollow having two opposite side walls, wherein a guide rail is provided internally on each of said opposite side walls, the guide rails being aligned to each other and extending substantially the length of the outer member, wherein the inner member has opposite side walls with respective elongated recesses thereon extending substantially the length of the inner member and in precise registration with respective guide rails on the outer member.

9. The tool of claim 7, further including the detent means secured to the outer member, wherein spaced-apart first and second notches are provided on the inner member, wherein the inner and outer members are retained in their normal position once the detent means engages the first notch on the inner member, and wherein the inner and outer members are retained in their extended position once the detent means engages the second notch on the inner member.

10. The tool of claim 9, wherein the outer member has an open proximate end and a blind distal end thereof, the inner member being received into the open proximal end of the outer member, wherein the outer member further has a first wall connecting said opposite side walls thereof, a slot being provided thereon close to the proximal end of the outer member, wherein the detent means is a spring, having a lip press-fitted within said slot and further having a bump, wherein the inner member has a second wall corresponding to said first wall of the outer member, and wherein the first notch is provided on the second wall of the inner member in proximity to the handle, and wherein the second notch is provided on the second wall of the inner member at an opposite end thereof distant from the handle.

11. The tool of claim 1, wherein the inner member is molded plastic and the outer member is die cast metal.

12. The tool of claim 1, wherein the inner member is die cast metal and the outer member is molded plastic.

13. A handle extension for a ratchet wrench, wherein the ratchet wrench has a handle of a circular cross-section, the handle extension comprising a two-piece assembly including inner and outer telescoping members, the inner member being secured to the handle of the ratchet wrench and the outer member being configured to provide a comfortable grip for the user, the inner member having a first notch at an end thereof proximal to the handle and further having a second notch at an end thereof distant from the handle, a spring secured to the outer member providing two alternate positions between the inner and outer members and constituting a normal position in which the spring engages the first notch and the outer member is disposed radially of and adjacent to the inner member and radially of the handle of the ratchet wrench, and an extended position in which the spring engages the second notch and the outer member is disposed rearwardly of and distal from the handle of the ratchet wrench, wherein the outer member is hollow having two opposite side walls, wherein a guide rail is provided internally on each of said opposite side walls, the guide rails being aligned to each other and extending substantially the length of the outer member, and wherein the inner member has opposite side walls with respective elongated recesses thereon extending substantially the length of the inner member and in precise registration with respective guide rails of the outer member, so that the elongated recesses slide along the respective guide rails.

14. The handle extension of claim 13, wherein the second member is press-fitted to the handle.

15. The handle extension of claim 13, wherein the second member is directly molded to the handle.

16. A tool comprising:

a handle, wherein the handle has a broader portion and a narrower portion longitudinally extending from the broader portion and integral thereto, and wherein a shoulder is formed therebetween, an adapter having a longitudinal channel shaped as an elongated member extending substantially the length thereof, wherein the narrower portion of the handle is secured within said longitudinal channel preventing detachment of the adapter from the handle and with said shoulder preventing the adapter from being moved toward the broader portion, wherein the adapter has opposite side walls with respective elongated recesses thereon extending substantially the length thereof, and wherein the adapter has a wall connecting said side walls and provided with spaced apart first and second notches, and further including a handle extending member telescopically engaging the adapter.

17. The tool of claim 16, wherein the narrower portion of the handle of the tool has a knurled surface.

18. The tool of claim 16, wherein a resiliently-biased detent means between the adapter and the handle extending member provides two alternating positions therebetween and constituting a normal position in which the handle extending member is disposed radially of and adjacent to the adapter and radially of the handle of the tool and an extended position in which the handle extending member is disposed rearwardly of and distal from the handle of the tool for providing increased manual leverage in using the tool.

19. The tool of claim 18, wherein the handle extending member is an elongated hollow member, having two opposite side walls, wherein a guide rail is provided internally on each of said opposite side walls, the guide rails being aligned to each other and extending substantially the length of the handle extending member and in precise registration with respective elongated recesses on the side walls of the adapter.

20. The tool of claim 18, wherein the detent means are secured to the handle extending member, wherein the handle and the handle extending member are retained in their normal position once the detent means engages the first notch on the adapter, and wherein the handle and handle extending member are retained in their extended position once the detent means engages the second notch on the adapter.

21. The tool of claim 20, wherein the handle extending member has an open proximate end and a blind distal end thereof, the adapter member being received into the open proximal end of the handle extending member, wherein the handle extending member further has a first wall connecting said opposite side walls thereof, a slot being provided thereon close to the proximal end of the handle extending member, wherein the detent means is a spring, having a lip press-fitted within said slot and further having a bump, wherein the first notch is provided on said wall of the adapter connecting the side walls thereof in proximity to the handle, and wherein the second notch is provided on said wall of the adapter connecting the side walls thereof at an opposite end thereof distant from the handle.

22. In a wrench having a conventional longitudinally-disposed handle, the combination of the handle having an adapter thereon, and an extension member carried by the handle, provided with a comfortable grip, and having a resiliently-biased detent connection with the adapter of the handle, wherein the extension member has at least two positions, including a first position in which the extension member is disposed substantially radially of and adjacent to the adapter of the handle, and further including a second slide-out position in which the extension member is disposed substantially rearwardly of and distal from the handle, such that additional torque may be applied to a fastener with the same force applied manually to the wrench in the second slide-out position of the extension member, and such that the adapter avoids any expensive machining of the conventional handle of the wrench to accommodate the detent connection with the extension member.

23. The combination of claim 22, wherein the wrench is a ratchet wrench.

* * * * *